US008708519B2

(12) United States Patent
Kovacik et al.

(10) Patent No.: US 8,708,519 B2
(45) Date of Patent: Apr. 29, 2014

(54) LED CONVERSION MODULE FOR INCANDESCENT WORK LIGHT

(75) Inventors: James D. Kovacik, Breckville, OH (US); Paul S. Blanch, Broadview Heights, OH (US)

(73) Assignee: Alert Stamping & Manufacturing Co., Inc., Bedford Heights, OH (US)

( * ) Notice: Subject to any disclaimer, the term of this patent is extended or adjusted under 35 U.S.C. 154(b) by 862 days.

(21) Appl. No.: 12/789,906

(22) Filed: May 28, 2010

(65) Prior Publication Data

US 2011/0292651 A1 Dec. 1, 2011

(51) Int. Cl.
*F21V 1/00* (2006.01)

(52) U.S. Cl.
USPC ..... 362/235

(58) Field of Classification Search
USPC ..... 362/398, 235, 249.02
See application file for complete search history.

(56) References Cited

U.S. PATENT DOCUMENTS

| | | | | |
|---|---|---|---|---|
| 4,774,647 | A | 9/1988 | Kovacik et al. | |
| 5,154,511 | A | 10/1992 | Veneskey | |
| 6,231,207 | B1 | 5/2001 | Kennedy et al. | |
| 6,857,756 | B2 | 2/2005 | Reiff et al. | |
| 7,338,189 | B2 * | 3/2008 | Kovacik et al. | 362/398 |
| 7,350,936 | B2 | 4/2008 | Ducharme et al. | |
| 7,367,692 | B2 | 5/2008 | Maxik | |
| 7,597,456 | B2 | 10/2009 | Catalano et al. | |
| 7,600,882 | B1 | 10/2009 | Morejon et al. | |
| 2006/0109662 | A1 * | 5/2006 | Reiff et al. | 362/373 |
| 2007/0103914 | A1 | 5/2007 | McCaffrey | |
| 2010/0008086 | A1 | 1/2010 | Broitzman | |
| 2010/0053957 | A1 | 3/2010 | Pawelko et al. | |

* cited by examiner

*Primary Examiner* — Britt D Hanley
*Assistant Examiner* — Brenitra M Lee
(74) *Attorney, Agent, or Firm* — Fraser Clemens Martin & Miller LLC; William J. Clemens

(57) ABSTRACT

An LED conversion module for converting an incandescent work light to an LED work light includes an enclosure housing a plurality of LEDs, wherein at least a portion of the enclosure permits light generated from the LEDs to pass therethrough. A screw base is coupled to the enclosure and extends outwardly therefrom. The screw base provides electrical communication between the LEDs and a screw-type light socket disposed in a work light handle. A hook is coupled to the enclosure to facilitate hanging the LED conversion module and handle from a support structure.

18 Claims, 4 Drawing Sheets

LED CONVERSION MODULE FOR INCANDESCENT WORK LIGHT

FIELD OF THE INVENTION

The invention relates to work lights and more particularly to an LED conversion module for use in an incandescent work light.

BACKGROUND OF THE INVENTION

Portable lights which can be manually moved and suspended about a work site to aid a user to obtain desirable lighting conditions are well known. It has been the practice to use incandescent light bulbs, suitably encased in light guards, for this purpose. Such lights are often referred to as work lights, trouble lamps, extension lights, inspection lights, and the like, and are commonly employed by mechanics and other workers who require a concentration of light in a frequently changing location. Such a work light is shown in U.S. Pat. No. 4,774,647 to Kovacik et al, There are several drawbacks associated with the use of incandescent light bulbs in work lights. For example, incandescent lights use a relatively large amount of electrical energy as compared to other types of lights such as fluorescent lights and LED lights; become hot during operation; and are known to fail when exposed to rough service conditions.

Further, due to the relatively large amount of electrical energy consumed by incandescent lights, legislative efforts are underway to phase out the use of incandescent lights. Accordingly, incandescent work lights may become obsolete in the event incandescent light bulbs become unavailable.

It would be desirable to produce an LED conversion module for use in an incandescent work light, wherein the LED conversion module minimizes a consumption of electrical energy and facilitates conveying the work light from site to site in a portable fashion.

SUMMARY OF THE INVENTION

Compatible and attuned with the present invention, an LED conversion module for use in an incandescent work light, wherein the LED conversion module minimizes a consumption of electrical energy and facilitates conveying the work light from site to site in a portable fashion, has surprisingly been discovered.

In one embodiment an LED module comprises an enclosure for housing a plurality of LEDs, the enclosure including at least a portion thereof permitting light to pass therethrough; a screw base coupled to the enclosure and extending outwardly therefrom, the screw base in electrical communication with the LEDs; and a hook coupled to the enclosure to facilitate hanging the LED module from a support structure.

In another embodiment, an LED module comprises a two piece enclosure having a substantially hollow interior and an opening formed in a surface of the enclosure; a lens disposed within the hollow interior of the enclosure substantially covering the opening formed in the surface of the enclosure; a reflector disposed within the hollow interior of the enclosure adjacent the lens, the reflector including a plurality of openings formed therein; a printed circuit board including a plurality of LEDs coupled thereto disposed within the hollow interior of the enclosure adjacent the reflector, the LEDs extending outwardly from a surface of the circuit board and extending through the openings formed in the reflector toward the lens; and a screw base coupled to the enclosure and extending outwardly therefrom, the screw base being in electrical communication with the LEDs of the printed circuit board.

In another embodiment, an LED work light comprises a handle including a threaded socket disposed adjacent an end thereof; an LED module including an enclosure for housing a plurality of LEDs, a screw base coupled to the enclosure and threadably received by the threaded socket of the handle, and a hook coupled to the enclosure, wherein the screw base is in electrical communication with the threaded socket and the LEDs; a neck clamp having a top end and a spaced apart bottom end, the top end receiving at least a portion of the screw base and the bottom end receiving the end of the handle, wherein the neck clamp facilitates substantially securing the screw base of the enclosure within the threaded socket of the handle.

BRIEF DESCRIPTION OF THE DRAWINGS

The above advantages of the invention will become readily apparent to those skilled in the art from reading the following detailed description of an embodiment of the invention in the light of the accompanying drawings, in which.

DETAILED DESCRIPTION OF THE PREFERRED EMBODIMENT OF THE INVENTION

Figure 1:
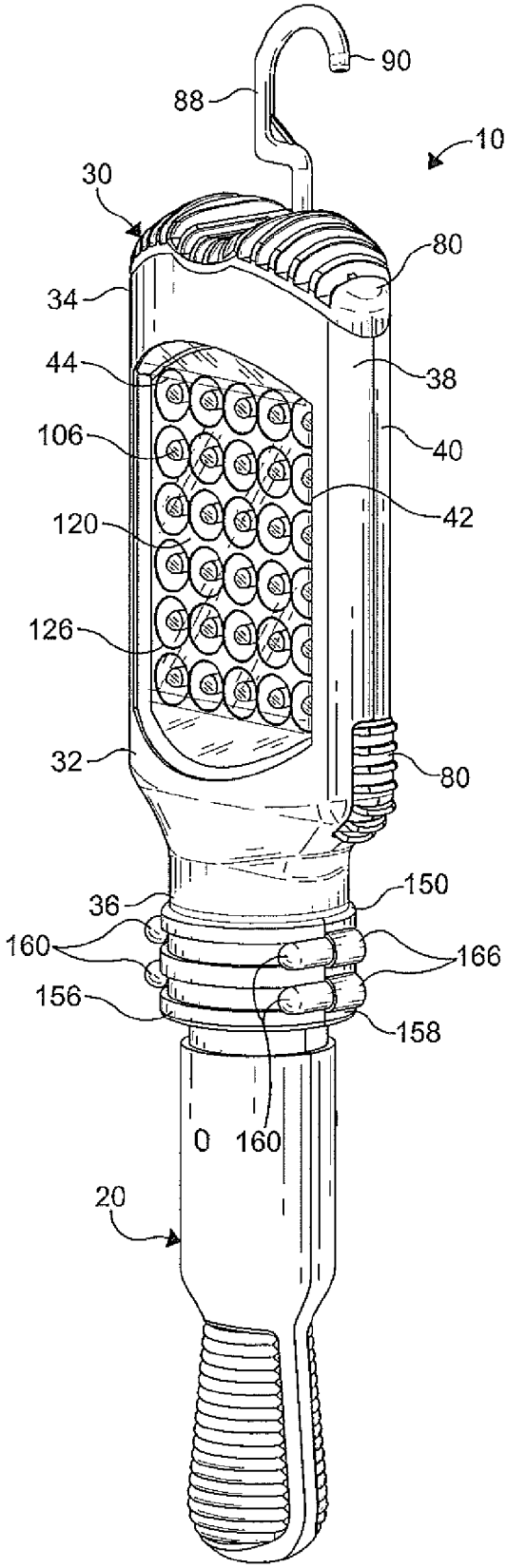
FIG. 1 is a perspective view of an LED conversion module coupled to an associated handle of a work light.

The following detailed description and appended drawings describe and illustrate an exemplary embodiment of the invention. The description and drawings serve to enable one skilled in the art to make and use the invention, and are not intended to limit the scope of the invention in any manner.

Referring now to the drawings, there is illustrated a work light 10 including a handle 20 and an LED conversion module 30 coupled thereto. A screw-type light socket 22 is disposed in an end of the handle 20. A lip 24 is typically formed on an outer surface of the handle 20 adjacent the end thereof. It should be understood that the handle 20 can be any work light handle including a standard screw-type receptacle to receive an Edison style incandescent lamp. It should also be understood that the typical incandescent work light includes a lamp guard (not shown) releasably secured to the end of the handle 20 adjacent the light socket 22. One such incandescent work light is shown in U.S. Pat. No. 4,774,647 to Kovacik et al. incorporated herein by reference in its entirety.

The LED conversion module 30 includes an enclosure 32 for supporting and generally enclosing a printed circuit board 100 and a reflector 120. The enclosure 32 includes a top end 34 and a bottom end 36, wherein a screw base 140 is disposed in the bottom end 36 and extends outwardly therefrom.

The enclosure 32 is formed from an enclosure front 38 and an enclosure back 40 which are joined together to form a substantially hollow interior for housing the printed circuit board 100 and the reflector 120. An opening 42 is formed in the enclosure front 34. A substantially clear lens 44 abuts an inner surface of the enclosure front 38 and covers the opening 42 formed therein. In the illustrated embodiment, the enclosure 32 and the opening 42 formed in the enclosure front 38 have a generally rectangular shape. It should be understood that the enclosure 32 and the opening 42 can have other shapes such as square or circular, for example. A plurality of locator pins 45 are formed on an inner surface of the lens 44 adjacent upper and lower peripheral edges thereof. A plurality of tabs 43 are formed adjacent side edges of the lens 44. The tabs 43 extend outwardly from the inner surface of the lens 44.

The enclosure front 38 includes a plurality of bosses 46 formed on the inner surface thereof adjacent upper and lower edges of the opening 42 in which a counter bore 48 and a blind hole 50 are formed. A pair of bosses 52 is also formed on the inner surface of the enclosure front 38 adjacent side edges of the opening 42. A blind hole 54 is formed in each of the bosses 52. A pair of spaced apart ribs 56 are formed on the inner surface of the enclosure front 38 adjacent the bottom end 36 of the enclosure 32.

The enclosure back 40 is constructed to cooperate with the enclosure front 38 to form the enclosure 32. The enclosure back 40 includes a plurality of bosses 58 formed on an inner surface thereof adjacent upper and lower ends of the back. The bosses 58 have a stepped end 60. The counter bore 48 formed in the bosses 46 of the enclosure front 38 receives the stepped end 60 of the bosses 58 formed in the enclosure back 40, thereby positioning the enclosure front 38 and the enclosure back 40 in substantial alignment. An aperture 62 is formed through each of the bosses 58 to the outside surface of the enclosure back 40. A head of a fastener 64 is positioned on the outside surface of the enclosure back 40 and a threaded end of the faster 64 extends through the aperture 62 and is received in the blind hole 50 formed in the associated boss 46 of the enclosure front 38. A pair of bosses 66 is formed on the inner surface of the enclosure back 40 adjacent the side edges. The bosses 66 have a stepped end 68 and an aperture 70 formed therethrough to the outside surface of the enclosure back 40. The stepped end 68 of the boss 66 abuts an end of the associated boss 52 formed in the enclosure front 38. A head of a fastener 72 is positioned on the outside surface of the enclosure back 40 and a threaded end of the faster 72 extends through the aperture 70 and is received in the blind hole 54 formed in the associated boss 52 of the enclosure front 38. A pair of spaced apart ribs 74 are formed on the inner surface of the enclosure back 40 adjacent the bottom end 36 of the enclosure 32. The ribs 74 cooperate with the ribs 56 formed in the enclosure front 38 to facilitate substantially securing the screw base 140 between the enclosure front 38 and the enclosure back 40 in the bottom end 36 of the enclosure 32.

The enclosure back 40 includes a plurality of spaced apart ribs 76. The ribs 76 extend horizontally outwardly form the inner surface of the enclosure back 40 to reinforce the enclosure back 40 and support the printed circuit board 100. Locator pins 78 extend outwardly from an edge of the ribs 76. The locator pins 78 cooperate with the printed circuit board 100 and the reflector 120 to position the printed circuit board 100 and the reflector 120 in a desired location in respect of the enclosure back 40. Rails 73 are also formed on the inner surface of the enclosure back 40 adjacent the bosses 66. The rails 73 receive the tabs 43 of the lens 44 to facilitate positioning the lens 40 in a desired location in respect of the opening 42 in the enclosure back 40.

A cushioned member 80 can be coupled to the peripheral edges of the enclosure 32. In the illustrated embodiment, three cushioned members 80 are provided, wherein the cushioned members include a plurality of lugs 82 depending therefrom. Slots 84, 86 are formed in peripheral edges of the enclosure front 38 and the enclosure back 40, respectively. The slots 84, 86 cooperate to receive the lugs 82 of the cushioned members 80. It should be understood that the cushioned members 80 can be coupled to the enclosure 32 employing an adhesive or a fastener, by welding, and any other suitable means. The cushioned members 80 are typically formed from a resilient material such as rubber, foam, or other suitable material, for example.

The LED conversion module 30 can be provided with a hook member 88 to facilitate hanging the work light 10 from a support structure. The hook member 88 includes a hook 90 formed at one end and a ball 92 formed at an opposite end. A hook holder 94 is disposed within the enclosure 32 to movably attach the hook member 88 thereto. The hook holder 94 includes a pair of spaced apart apertures 95 formed therein to receive the stepped ends 60 of the bosses 58 formed in the upper end of the enclosure back 40, wherein opposing ends of the hook holder 94 are secured between the bosses 46 and the bosses 58. A cup 96 is formed in the hook holder 94 between the apertures 95. The cup 96 is in substantial alignment with an opening 97 formed in the enclosure back 40. The ball 92 is received in the cup 96 to position the ball 92 between the inner surface of the enclosure back 40 and the cup 96 to form a ball joint pivotally connecting the hook member 88 to the enclosure 32. The hook 90 extends through the opening 97 formed in the enclosure back 40 and can be moved in respect of the enclosure 32 to facilitate hanging the work light 10 from a support structure. As clearly shown in FIG. 3, a recess 98 can be formed in the outer surface of the enclosure back 40 to receive the hook 90 when the hook 90 is not in use, for example.

The printed circuit board 100 includes a front surface 102 and a spaced apart back surface 104. A plurality of light-emitting diodes 106 (LEDs) is coupled to the printed circuit board 100 and extends outwardly from the front surface 102 thereof. The printed circuit board 100 also includes a conventional electrical circuit (not shown) providing electrical communication between the screw base 140 and the LEDs 106. In the illustrated embodiment, thirty (30) LEDs 106 are provided in a substantially rectangular row and column array. It should be understood that additional or fewer LEDs 106 can be provided and that the LEDs 106 can be arranged in a square array, a circular array, and other arrays, as desired. Apertures 108 are formed in the printed circuit board 100. The apertures 108 receive the locator pins 78 extending from the ribs 76 of the enclosure back 40 to facilitate positioning the circuit board 100 in a desired position within the enclosure 32, The printed circuit board 100 is disposed within the enclosure 32 having the back surface 104 of the printed circuit board facing the inside surface of the enclosure back 40.

The reflector 120 includes a front surface 122 and a back surface 124. A plurality of generally conically shaped depressions 126 is formed in the front surface 122 of the reflector 120. The depressions 126 are formed in an array matching the configuration of the array of the LEDs 106 coupled to the printed circuit board 100. It should be understood that the depressions 126 formed in the front surface 122 of the reflector 120 form corresponding generally conically shaped protrusions 127 in the back surface of the reflector. An opening 128 is formed in each of the depressions 126. The reflector 120 is disposed within the enclosure 32 having at least a portion of the back surface 124 of the reflector 120 abutting the front surface 102 of the printed circuit board 100 and at least a portion of the front surface 122 of the reflector 120 abutting the inner surface of the lens 44. The LEDs 106 extend through the openings 128 formed in the depressions 126 of the reflector 120 and are received within the depressions 126 formed in the front surface 122 of the reflector 120. The front surface 122 of the reflector 120 is a reflective surface causing light generated by the LEDs 106 to be directed outwardly from the front surface 122 of the reflector 120 toward the lens 44 covering the opening 42 formed in the enclosure front 38. It should be understood that the reflective surface can be formed by disposing a reflective material such as chrome, a reflective paint, a reflective film, and the like, for example, on the front surface 122 of the reflector 120. A pair of spaced apart bosses 130 are formed adjacent each side edge of the reflector 120. The bosses 130 include a blind hole 132 formed therein to receive the locator pins 78 extending from the ribs 76 of the enclosure back 40 to facilitate positioning the reflector 120 in a desired position within the enclosure 32. Apertures 134 are formed in the reflector 120 adjacent a peripheral edge thereof. The apertures 134 receive the locator pins 45 extending from the inner surface of the lens 44 to facilitate aligning the lens 45 with the reflector 120.

The screw base 140 includes a top end 142 and a spaced apart lower threaded end 144. The top end 142 of the screw base 140 is disposed within the hollow interior of the enclosure 32 and the threaded end 144 extends from the bottom end 36 of the enclosure 32. The threaded end 144 is configured to threadably engage the screw-type light socket 22 disposed in the handle 20 of the work light 10 and couple the LED conversion module 30 to the handle 20. In the illustrated embodiment, the threaded end 144 is configured to be received by standard Edison style screw-type light sockets. It should be understood that the threaded end 144 can be adapted to be received by other types of light sockets. An annular rib 146 is formed on an outer surface of the screw base 140 adjacent the top end 142. The annular rib 146 is received between the spaced apart ribs 56, 74 of the enclosure front 38 and the enclosure back 40, respectively, to facilitate retaining the screw base 140 therebetween. Electrical conduits (not shown) are provided extending from the threaded end 144 to the electrical circuit of the printed circuit board 100. It should be understood that the threaded end 144 is formed from an electrically conductive material to provide electrical communication between the screw-type light socket 22 of the handle 20 and the electrical conduits. It should also be understood that a control circuit can be provided in electrical communication with the electrical conduits and the printed circuit board 100 to provide a desired electrical current to the printed circuit board 100. A plurality of detents 148 can be formed on the outer surface of the screw base 140.

A neck clamp 150 is provided to facilitate coupling the LED conversion module 30 to the handle 20. The neck clamp 150 is a generally ring-shaped member having a top end 152 configured to encircle a portion of the screw base 140 and a spaced apart bottom end 154 configured to encircle an end of the handle 20 adjacent the screw-type light socket 22 disposed therein. The neck clamp 150 includes a generally C-shaped first clamp member 156 and a cooperating generally C-shaped second clamp member 158, wherein the clamp members 156, 158 are joined together to form the generally ring shaped neck clamp 150. A pair of bosses 160 is formed adjacent each side edge of the first clamp member 156. The bosses 160 have a stepped end 162 and a blind hole 164 formed therein. A pair of bosses 166 is formed adjacent each side edge of the second clamp member 158. The bosses 166 include a first counter bore 168 formed in one end and a second counter bore 170 formed in an opposite end. An aperture 172 is formed in each of the bosses 166 extending between the counter bores 168, 170. The first counter bore 168 of the bosses 166 receives the stepped end 162 of the bosses 160 to facilitate placing the blind hole 164 of the bosses 160 in substantial axial alignment with the aperture 172 of the bosses 166. A plurality of fasteners 174 is employed to join the clamp members 156, 158, wherein a threaded end of the fastener 174 is received by the associated aperture 172 and the blind hole 164 and a head of the fastener is received within the second counter bore 170 formed in the boss 166.

A plurality of arcuate detents 176 is formed on an inner surface of the neck clamp 150 adjacent the top end 152 thereof. The detents 176 are configured to engage the detents 148 formed in the screw base 140 and facilitate coupling the top end 152 of the neck clamp 150 to the screw base 140. An annular lip 178 extends outwardly from an inner surface of the neck clamp 150 adjacent the bottom end 154 thereof. A rib 180 is also formed on the inner surface of the neck clamp 150 spaced apart from the annular lip 178. The annular lip 178 and the rib 180 are configured to receive therebetween the lip 24 formed adjacent the end of the handle 20.

Figure 2:
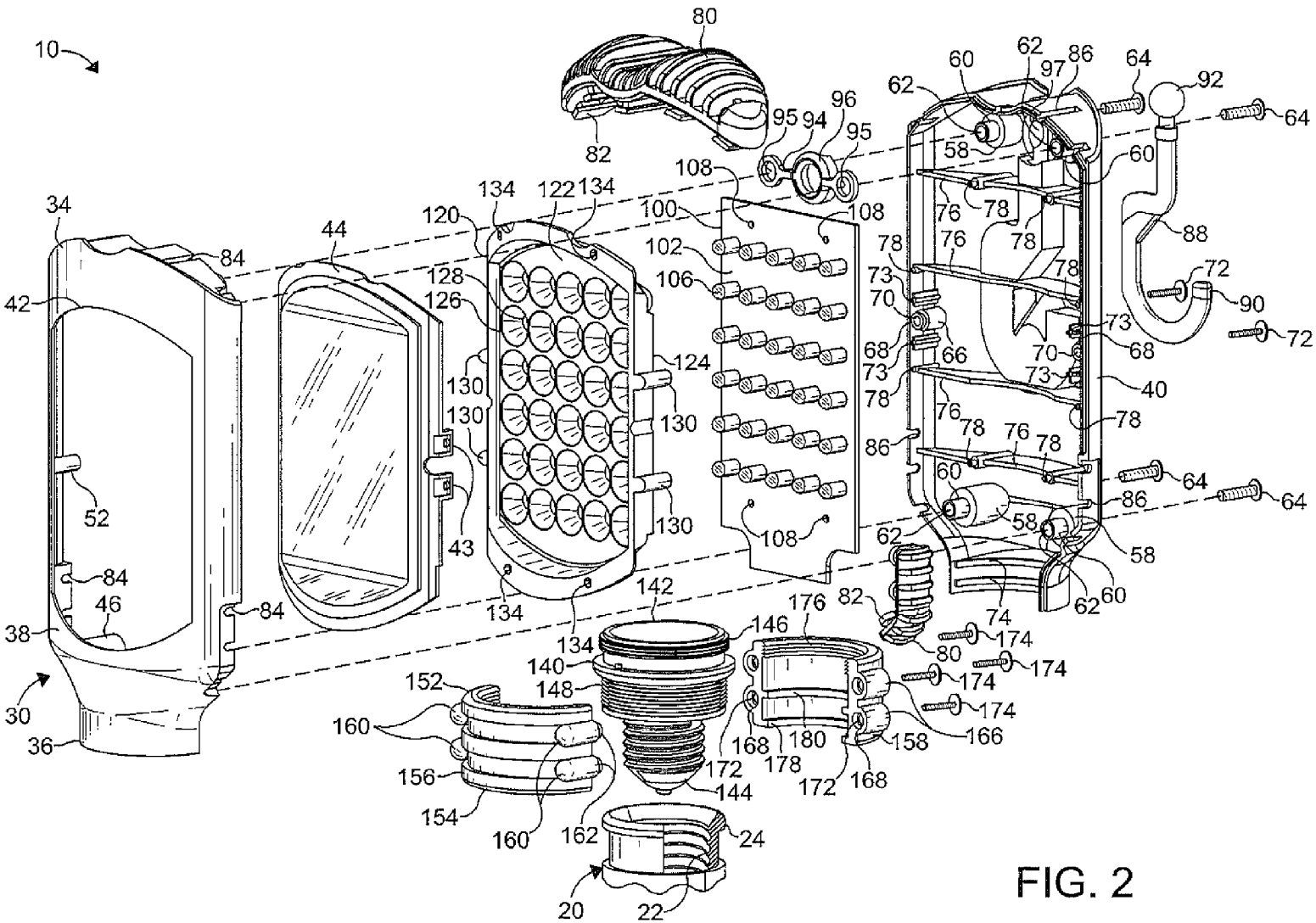
FIG. 2 is an exploded front perspective view of the LED conversion module illustrated in FIG. 1.
Figure 3:
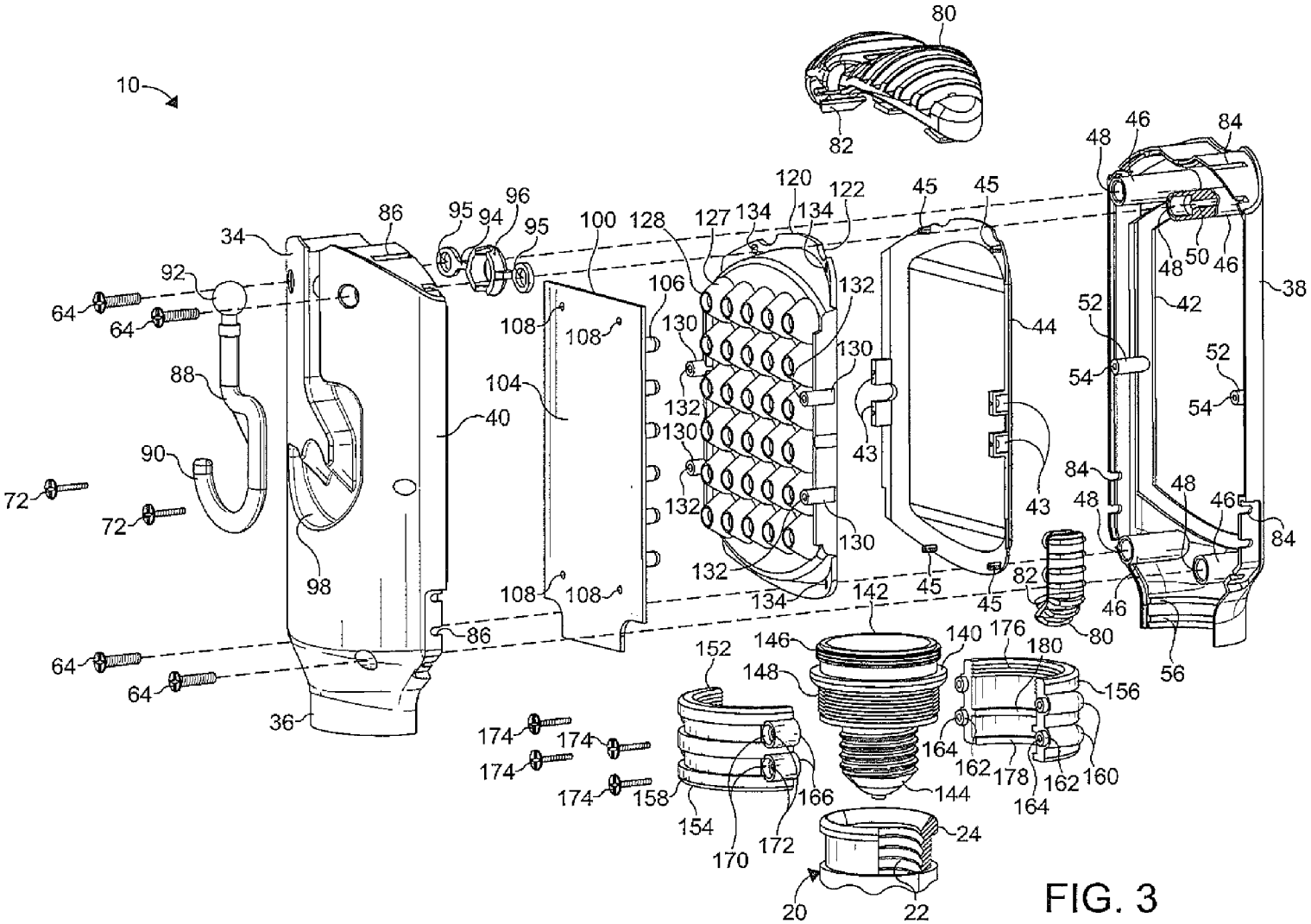
FIG. 3 is an exploded rear perspective view of the LED conversion module illustrated in FIG. 1.

The LED conversion module 30 is assembled as shown in FIGS. 2-3. The fasteners 64, 72 are employed to draw the enclosure front 38 and the enclosure back 40 toward each other and substantially secure the printed circuit board 100, the reflector 120, and the lens 44 in a stacked relation within the enclosure 32. Additionally, the cushioned members 80 and the screw base 140 are secured between the enclosure front 38 and the enclosure back 40 of the enclosure 32.

In use, the LED conversion module 30 is used to replace an incandescent bulb and a lamp guard typically used with incandescent work lights. The incandescent light and the lamp guard are removed from the handle 20 of the work light 10. The threaded end 144 of the screw base 140 is threadably received by the screw-type light socket 22 of the handle 20. The neck clamp 150 is positioned to encircle a portion of the screw base 140 and the handle 20 to facilitate coupling the LED conversion module 30 to the handle 20. The top end 152 of the neck clamp 150 engages the screw base 140 to cause the detents 176 of the neck clamp 150 to abut the detents 148 formed on the outer surface of the screw base 140. The bottom end 154 of the neck clamp 150 receives the end of the handle 20, wherein the lip 24 of the handle 20 is positioned between the annular lip 178 and the rib 180 formed on the inner surface of the neck clamp 150. The fasteners 174 are received in the apertures 172 formed in the bosses 166 of the second clamp member 158, wherein the threaded end of each of the fasteners 174 is received in the blind hole 164 formed in the associated boss 160 of the first clamp member 156. The fasteners 174 are employed to draw the first clamp 156 and the second clamp 158 together and substantially secure the neck clamp 150 around the screw base 140 of the LED conversion module 30 and the end of the handle 20. The neck clamp 150 relieves the force that would otherwise be applied to the threaded end 144 and the socket 22 when the work light 10 is suspended from the hook member 88.

The LED conversion module 30 enables a user to convert an incandescent work light into the LED work light 10. The LED conversion module 30 replaces both the lamp guard and the incandescent light of the incandescent work light. The hook 90 of the LED conversion module 30 facilitates conveying the work light 10 from site to site and hanging the work light 10 from a support structure. Further, the use of the LEDs 106 in place of the incandescent light minimizes the consumption of electrical energy. The LEDs 106 provide a relatively cool operating temperature for the work light 10 as compared to the incandescent bulb. The relatively long service life of the LEDs 106, which can be up to 50,000 hours or more, and the greater impact resistance of the LEDs 106, as compared to incandescent lights, maximize the service life of the LED conversion module 30. Further, in the event incandescent lights become unavailable, the LED conversion module 30 enables users to convert the incandescent work light to the LED work light 10 rather than disposing of the incandescent work light.

Figure 4:
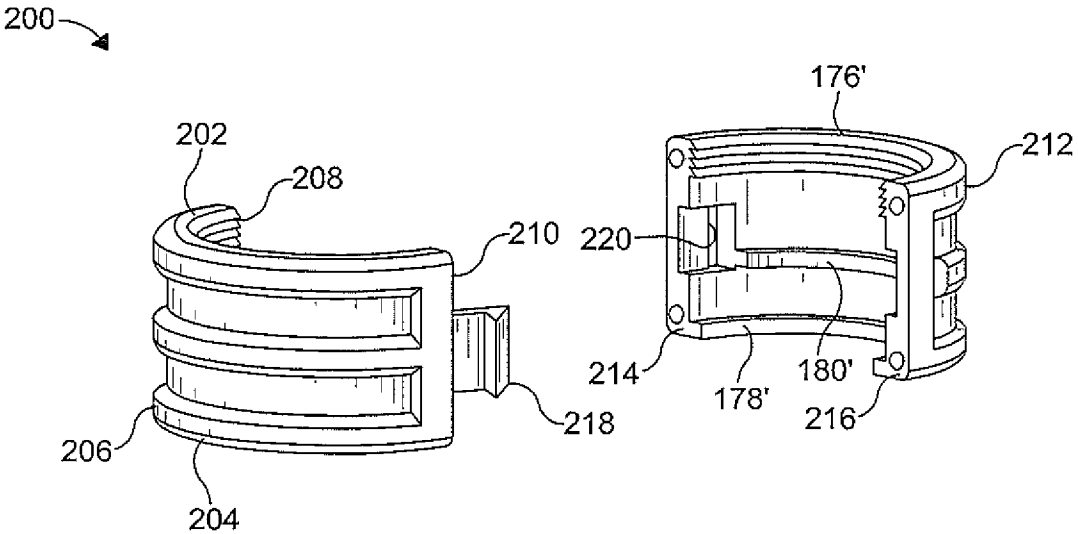
FIG. 4 is an exploded perspective view of an alternate embodiment neck clamp for use with the LED conversion module illustrated in FIGS. 1-3.

FIG. 4 illustrates an alternative embodiment of the neck clamp 150 shown in FIGS. 1-3. In FIG. 4, there is shown a snap together neck clamp 200 for use with the LED conversion module 30 and the handle 20 shown in FIGS. 1-3. Structure similar to that illustrated in FIGS. 1-3 includes the same reference numeral and a prime (') symbol for clarity. The neck clamp 200 is a generally ring-shaped member having a top end 202 and a spaced apart bottom end 204. The neck clamp 200 includes a generally C-shaped first clamp member 206 having edges 208, 210 and a cooperating generally C-shaped second clamp member 212 having edges 214, 216. Locking tabs 218 are formed on and extend outwardly from the edges 208, 210 of the first clamp member 206. An inwardly extending shoulder 220 is formed on an inner surface of the second clamp member 212 adjacent the edges 214, 216 thereof. As the edges 208, 210 are moved toward the edges 214, 216 respectively, the tabs 218 are deflected inwardly by the shoulders 220 and then spring back to cooperate with the shoulders 220 to snap-fit together the clamp members 206, 210 to form the neck clamp 200. The remaining structure and function of the neck clamp 200 are substantially similar to the structure and function of the neck clamp 150 shown in FIGS. 1-3.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An LED module comprising:

an enclosure forming an interior space housing a plurality of LEDs, said enclosure having an opening permitting light generated by said LEDs to exit said enclosure;

a screw base coupled to said enclosure and extending outwardly therefrom, said screw base adapted to engage an electrical socket for providing electrical power to said LEDs;

a ring-shaped neck clamp having a top end and a spaced apart bottom end, said top end receiving and encircling at least a portion of said screw base and said bottom end adapted to receive and encircle an end of a handle including the electrical socket; and a hook coupled to said enclosure for hanging the LED module from a support structure.

2. The LED module of claim 1, further comprising a printed circuit board disposed in the interior space of said enclosure, said LEDs being coupled to said printed circuit board and extending outwardly from a surface thereof.

3. The LED module of claim 1, further comprising a reflector disposed in the interior space of said enclosure, said reflector including a plurality of openings formed therein, wherein each of said LEDs extends through an associated one of the openings formed in said reflector.

4. The LED module of claim 1, further comprising at least one cushion member disposed on an outer surface of said enclosure.

5. The LED module of claim 1, wherein the opening of said enclosure permitting light to exit is closed by a substantially clear lens.

6. The LED module of claim 1, wherein said hook is moveably coupled to said enclosure.

7. An LED module comprising:

a two piece enclosure having a substantially hollow interior and an opening formed in a surface of the enclosure;

a clear lens disposed within the hollow interior of said enclosure substantially covering the opening of said enclosure;

a reflector disposed within the hollow interior of said enclosure adjacent said lens, said reflector including a plurality of openings formed therein;

a printed circuit board including a plurality of LEDs coupled thereto disposed within the hollow interior of said enclosure adjacent said reflector, each of said LEDs extending outwardly from a surface of said circuit board and extending through an associated one of the openings formed in said reflector toward said lens;

a screw base coupled to the enclosure and extending outwardly therefrom, said screw base adapted to engage an electrical socket for providing electrical power to said LEDs; and a neck clamp having a top end and a spaced apart bottom end, said top end receiving said screw base and said bottom end adapted to receive an end of a work light handle for coupling the LED module to the handle.

8. The LED module of claim 7, wherein said lens has a plurality of locator pins extending therefrom and said reflector has a plurality of apertures formed therein, each of said locator pins engaging an associated one of the apertures.

9. The LED module of claim 7, wherein said reflector includes a reflective surface adjacent to and facing said lens.

10. The LED module of claim 7, further comprising a hook coupled to said enclosure for hanging the LED module from a support structure.

11. The LED module of claim 10, wherein said hook is moveably coupled to said enclosure.

12. The LED module of claim 7, further comprising at least one cushion member disposed on an outer surface of said enclosure.

13. The LED module of claim 7, further comprising at least one fastener joining together said two pieces of said enclosure and securing said lens, said reflector, and said printed circuit board in the hollow interior.

14. An LED work light comprising:

a handle including a threaded socket disposed adjacent an end thereof;

an LED module including an enclosure housing a plurality of LEDs, a screw base coupled to said enclosure and threadably received by said threaded socket of said handle, and a hook coupled to said enclosure, wherein said screw base provides electrical communication between said threaded socket and said LEDs; and a neck clamp having a top end and a spaced apart bottom end, said top end receiving at least a portion of said screw base and said bottom end receiving said end of said handle, wherein said neck clamp secures said screw base within said threaded socket relieves a force from said screw base and said threaded socket when the LED work light is suspended from the hook.

15. The LED work light of claim 14, further comprising a printed circuit board disposed within said enclosure, said LEDs being coupled to said printed circuit board and extending outwardly from a surface thereof.

16. The LED work light of claim 14, further comprising a reflector disposed within said enclosure, said reflector including a plurality of openings formed therein, wherein each of said LEDs extends through an associated one the openings formed in said reflector.

17. The LED work light of claim 14, wherein said hook is moveably coupled to said enclosure and said enclosure has a recess formed in an outer surface for receiving said hook in a stored position.

18. The LED work light of claim 14, further comprising at least one cushion member disposed on an outer surface of said enclosure.

* * * * *